US008904588B2

(12) United States Patent
Taub

(10) Patent No.: US 8,904,588 B2
(45) Date of Patent: Dec. 9, 2014

(54) CLEANING DEVICE

(71) Applicant: Stanley Taub, New York, NY (US)

(72) Inventor: Stanley Taub, New York, NY (US)

( * ) Notice: Subject to any disclaimer, the term of this patent is extended or adjusted under 35 U.S.C. 154(b) by 77 days.

(21) Appl. No.: 13/720,054

(22) Filed: Dec. 19, 2012

(65) Prior Publication Data

US 2014/0165315 A1 Jun. 19, 2014

(51) Int. Cl.
*A47L 25/00* (2006.01)

(52) U.S. Cl.
CPC ..... *A47L 25/005* (2013.01)
USPC ..... 15/104.002; 15/230.11; D4/122

(58) Field of Classification Search
CPC .. B05C 17/02; B05C 17/0222; A47L 25/005; B08B 7/0028
USPC ..... 15/104.002, 230.11; D4/122
See application file for complete search history.

(56) References Cited

U.S. PATENT DOCUMENTS

| | | | | |
|---|---|---|---|---|
| 2,401,842 | A | 6/1946 | Slater | |
| 2,423,962 | A | 7/1947 | Clark et al. | |
| 2,542,774 | A | 2/1951 | Hutchinson | |
| 2,658,217 | A | 11/1953 | Green | |
| 3,342,325 | A | 9/1967 | Dreher | |
| 3,381,325 | A | 5/1968 | Reineman | |
| 3,398,418 | A | 8/1968 | Bogner et al. | |
| 3,682,690 | A * | 8/1972 | Amos | 15/209.1 |
| D281,654 | S | 12/1985 | Bladh et al. | |
| 4,571,769 | A | 2/1986 | Ford | |
| 4,765,353 | A * | 8/1988 | Rhoades | 134/138 |
| 4,979,257 | A | 12/1990 | Heneveld | |
| D336,784 | S | 6/1993 | Yen | |
| 5,333,341 | A | 8/1994 | Heneveld | |
| 5,400,459 | A | 3/1995 | Jarecke et al. | |
| 7,111,351 | B1 | 9/2006 | DeRoma | |
| D539,545 | S | 4/2007 | Crane et al. | |
| 7,213,291 | B2 * | 5/2007 | Cheng | 15/104.2 |
| 2009/0226657 | A1 | 9/2009 | Thiele | |
| 2011/0146011 | A1 | 6/2011 | Day | |

FOREIGN PATENT DOCUMENTS

| | | |
|---|---|---|
| EP | 0108062 | 9/1987 |
| JP | 3092551 U | 12/2002 |
| KR | 20110054402 | 5/2011 |

* cited by examiner

*Primary Examiner* — Shay Karls
(74) *Attorney, Agent, or Firm* — Lucas & Mercanti, LLP

(57) ABSTRACT

A cleaning device has a cylindrical housing with a semi-cylindrical cradle and a semi-cylindrical cover which is rotatably mounted in the cradle. A roller is rotatably mounted in the cover and has an adhesive sleeve thereon. Because the cradle, cover, roller and sleeve are coaxial, it makes the device an easily usable cleaning device.

14 Claims, 3 Drawing Sheets

CLEANING DEVICE

BACKGROUND OF THE INVENTION

1. Field of the Invention

This Invention relates to a device for cleaning various surfaces and more particularly to a small, compact device having a roller with an adhesive elastomeric surface which is contained within a housing with a removable cover.

2. Prior Art

Cleaning devices which employ a roller and are enclosed within a housing having a removable cover are known. See, for example, U.S. Pat. Nos. 2,542,774; 2,658,217; 3,381,325; 4,979,257; 5,333,341; 7,213,291; D281,654; and D539,545. Typically, these cleaning devices are for lint and employ a cover that can act as a handle which extends from the housing in the open position.

SUMMARY OF THE INVENTION

With the advent of cell phones, smart phones and personal digital assistants (PDA), Applicant has recognized a need for a small, compact cleaning device which can be used to clean the screens of these small electronic devices. Applicant has invented a small, compact cleaning device that can be used to clean the screens of various electronic devices. For example, the device can be used to clean the screen of a cell phone, the surface of a recorded or compact disc and other small surfaces. The cleaning device of the present Invention has a housing with a retractable cover which encompasses a roller. The cover keens the roller clean and free of debris when it is not in use. When it is time to use the cleaning device, the cover retracts and rotates inside the housing so as to expose the roller. The roller has a tacky, adhesive surface. The roller rolls across the screen and cleans the screen. When the user is done cleaning the screen with the cleaning device, the cover is rotated to close the cleaning device and to allow the cleaning device to be stored in a user's pocket or pocketbook for its next use. The cleaning device is intended to be held between the user's thumb and index finger thereby allowing accurate control of the cleaning device during the cleaning operation. The tacky, adhesive surface is especially useful for cleaning finger prints and smudges from a screen of an electronic device.

Furthermore, it has been found that bacteria, such as Staphylococcus epidermis and *Streptococcus viridians* can be on a touch screen of a phone or other device because of the finger print marks left by the user. It has been found that after cleaning the screen with the roller of the present Invention that bacteria are removed from the screen. Thus, the present Invention can prevent or hinder the transmission of disease both from personal devices as well as publicly used touch screens.

Broadly, the cleaning device of the present invention can be defined as a device for cleaning a surface, comprising:

- a cylindrical housing having a semi-cylindrical cradle and a semi-cylindrical cover rotatably mounted inside the cradle;
- roller rotatably mounted inside the cover; and
- an adhesive sleeve mounted on the roller, between the roller and the housing, for cleaning a surface on which the sleeve rolls when the cover has been rotated to an open position.

Preferably, the roller has a pin extending axially outward from each axial end of the roller; the cover has an end wall at each axial end of the cover, a blind hole in each end wall of the cover, the blind hole in each end wall of the cover is open axially inward and closed axially outward, and an open ring protrusion extending axially outward from each end wall of the cover, each end wall of the cover axially opposes a corresponding axial end of the roller, and the pin of each axial end of the roller is rotatably mounted in the blind hole of the corresponding end wall of the cover; and the cradle has an end wall at each axial end of the cradle, a blind hole in each axial end wall of the cradle, the blind hole in each end wall of the cradle is open axially inward and closed axially outward, each end wall of the cradle axially opposes a corresponding end walls of the cover, and the ring protrusion of each end wall of the cover is rotatably mounted in the blind hole of the corresponding end wall of the cradle.

The outer radial diameter of the ring protrusion is substantially the same as the inner diameter of the blind hole in the end wall of the cradle.

Preferably, the cover has a radial protrusion extending radially outward from an axial edge of the semi-cylindrical cover.

Preferably, the adhesive sleeve is made of an elastomeric material.

Suitable elastomeric materials are thermoplastic rubber (TPR compound). They belong to a class of thermoplastic elastomers and are made from a mix of styrene and butadiene so as to provide a tacky (adhesive-like) surface.

Preferably, each end wall of the cover is semicircular with an open ring protrusion extending axially outward from the end wall and each end wall of the cradle is semi-circular.

Preferably, each semi-circular end wall of the cover, and the ring protrusion of each end wall of the cover, and the blind hole in each end wall of the cover are coaxial.

Preferably, each semi-circular end wall of the cradle and the blind hole in the end wall of the cradle are coaxial.

Preferably, slits are formed in each end wall cover between blind hole and the open ring protrusion. These slits are curved and provide flexibility in the end wall of the cover in the area of the blind hole.

Preferably, when the cleaning device is in the open position, the inner radial surface of the cradle and the outer radial surface of the cover are aligned with each others.

Preferably, the cradle, the cover and the roller are all coaxial.

Preferably, the pin has an axially inward sleeve that mounts axially inside the roller. It is also preferred that the pin have two radially stepped axial protrusions which extend axially outward from the pin. These two radial steps are coaxial.

Preferably, the two radial steps comprise a first radial step which is axially adjacent the roller and a second radial step which is axially adjacent and radially inward from the first radial step. The second radial step is rotatably mounted in the blind hole of the end wall of the cover and the first radial step is axially adjacent the open ring protrusion of the cover.

Preferably, the cover and the cradle are made of a clear plastic material such as acrylonitrile butadiene styrene (ABS) or ABS plastic, such that one can see the inside roller with its adhesive surface. The inside roller can contain different colored tacky materials to add an element of eye appeal to the device. Any conventional hard plastic material can be used for the cover and cradle.

These and other aspects of the present Invention may be more readily understood by reference to one or more of the following drawings.

DETAILED DESCRIPTION OF THE INVENTION

Figure 1:
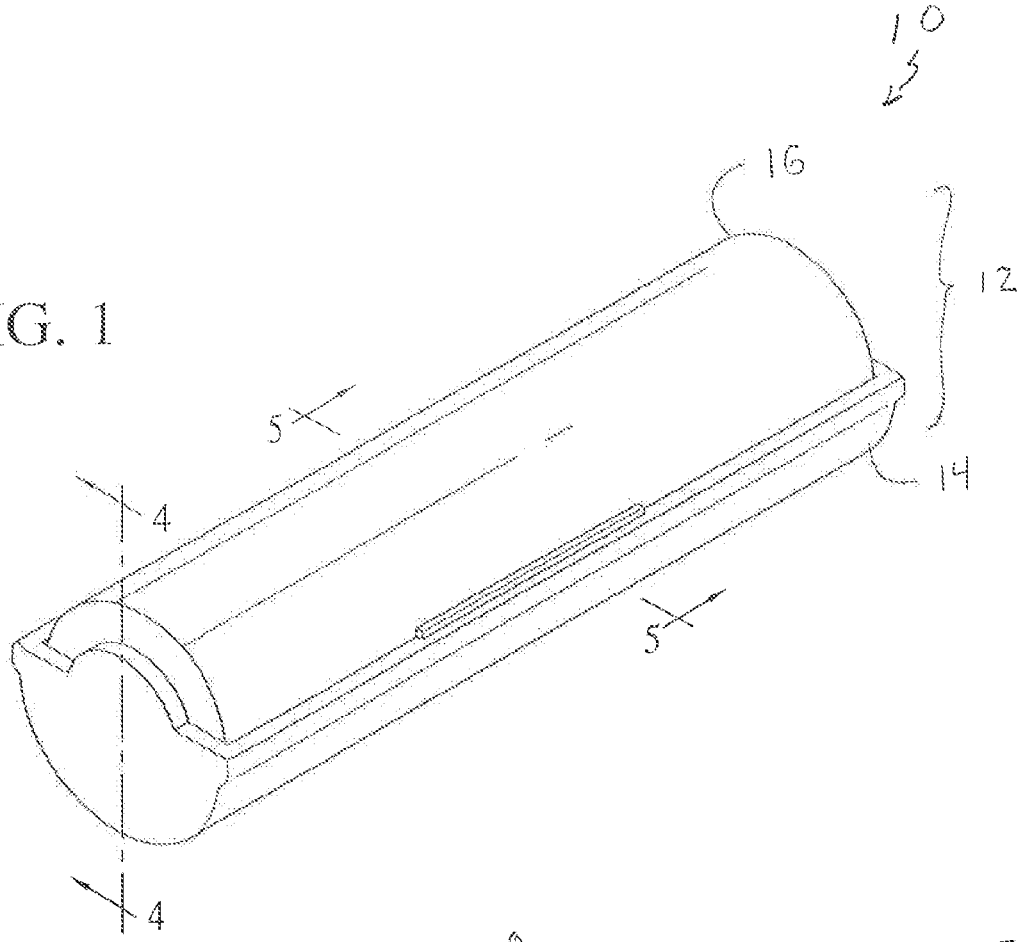
FIG. 1 is a perspective view of the cleaning device of the present. Invention in the closed position.
Figure 2:
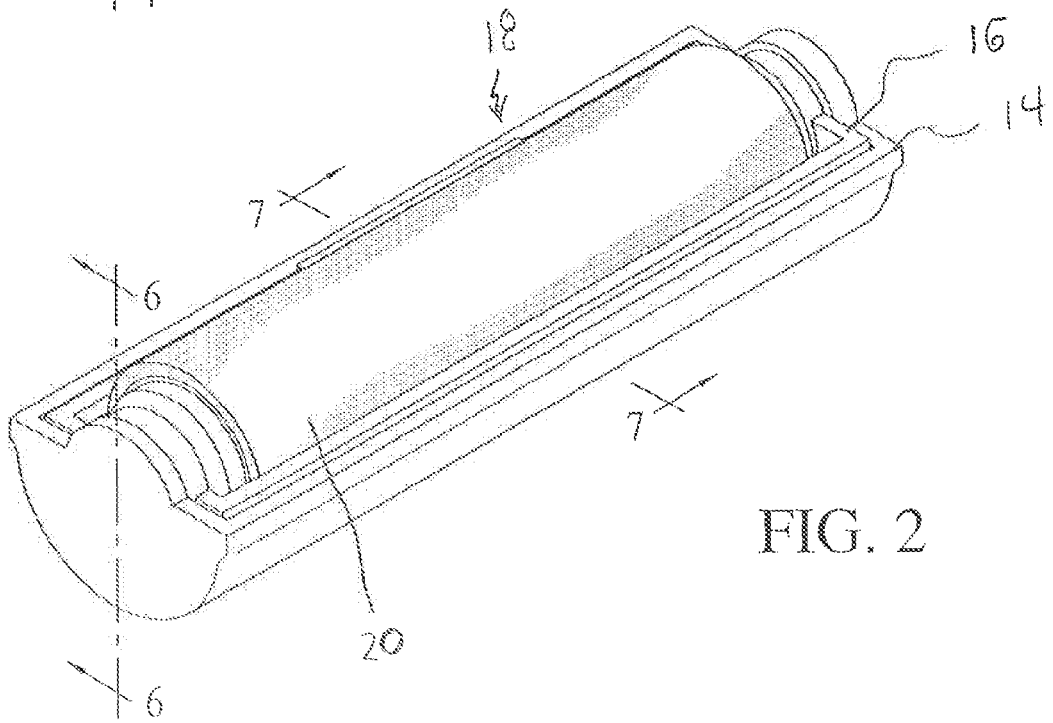
FIG. 2 is a perspective view of the cleaning device of the present Invention of FIG. 1 in the open position.
Figure 3:
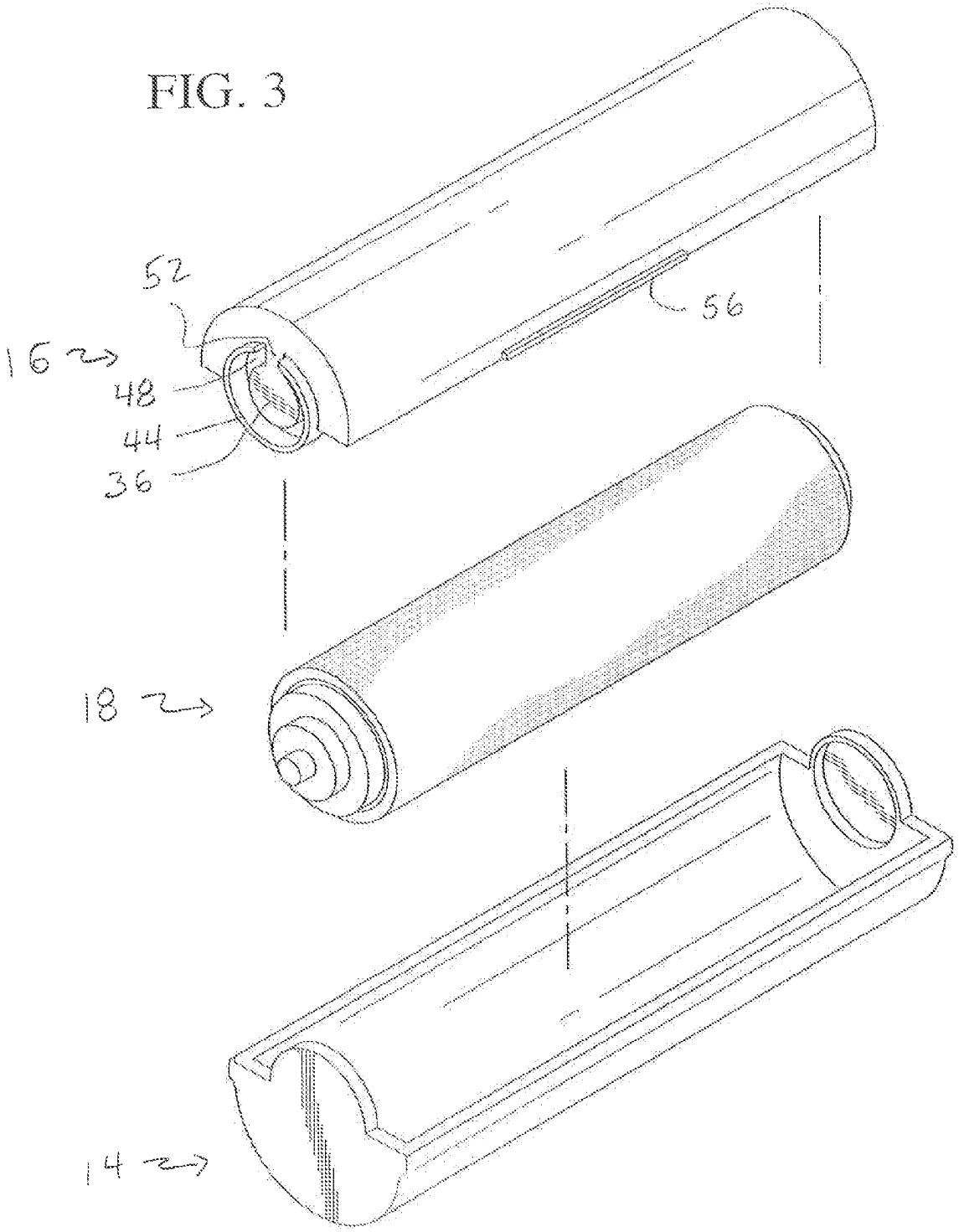
FIG. 3 is an exploded view of the cleaning device of FIG. 1.
Figure 4:
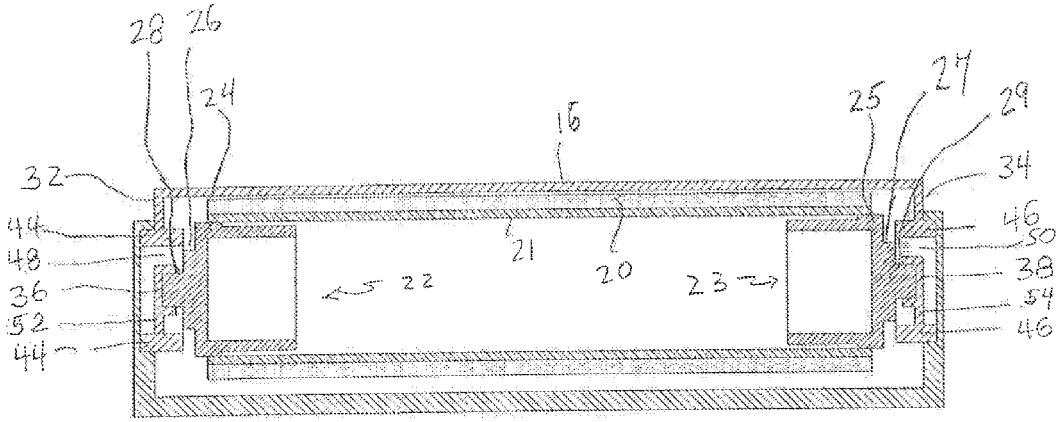
FIG. 4 is a cross section along line 4-4 of FIG. 1.
Figure 5:
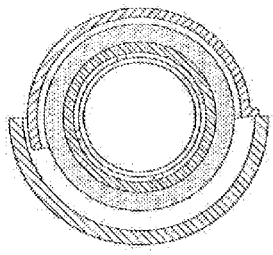
FIG. 5 is a cross sectional, view along line 5-5 of FIG. 1.

FIG. 1 illustrates cleaning device 10 having cylindrical housing 12. Cylindrical housing 12 is made up of semi-cylindrical cradle 14 and semi-cylindrical cover 16. Semi-cylindrical cover 16 is rotatably mounted inside of cradle 14 such that when cover 16 is rotated around the cylindrical axis of the cleaning device, cover 16 nests inside cradle 14 because the outside cylindrical surface of cover 16 passes inside the inner cylindrical wall of cradle 14 such that cradle 14 is coaxial with cover 16 and there is a space between the outer wall of cover 16 and the inner wall of cradle 14 to allow for the cover to easily rotate within cradle 14.

Roller 18 is rotatably mounted inside cover 16. Roller 18 has an adhesive sleeve 20 positioned on the exterior of roller 18. As can be seen, there is a gap between the exterior of adhesive sleeve 20 and the inside wall of cover 16 to allow the adhesive sleeve to freely rotate within cover 16.

Roller 18 has an inner cylinder 21 on which adhesive sleeve 20 resides. One axial end of roller 18 has a pin 22 and the other axial end of the roller 18 has a pin 23. Pin 22 has an axially inward sleeve 24 which resides inside inner cylinder 21 to fix cylinder 21 to pin 22. Pin 23 has axially inward sleeve 25 that resides inside inner cylinder 21 and fixes cylinder 21 to pin 23. Pin 22 has a first radial step 26 and a second radial step 28. Pin 23 has first radial step 27 and a second radial step 29.

Cover 16 has first end wall 32 and second end wall 34 at the other axial end of cover 16. In first end wall 32 is first blind hole 36 while, in second end wall 34, there is second blind hole 38. Second radial step 28 is rotatably mounted in first blind hole 36 while second radial step 29 is rotatably mounted in second blind hole 38. First and second hole 36, 38 have a diameter slightly greater than second radial step 28 and 29 so as to allow rotation of roller 18 inside cover 16.

First end wall 32 has first open ring protrusion 44 which extends axially outward from first end wall 32. Second end wall has second open ring protrusion 46 which extends axially outward from second end wall 34. Preferably, the outer diameter of first radial step 26 and 27 aligns with the inner diameter of first and second open ring protrusion 44 and 46, respectively.

Semi-circular slits 48 and 50, are shown in end wall 32 and end wall 34 and provide flexibility to blind hole 36 and 38. Blind hole 36 and 38 are connected to end wall 32 and 34 by extension 52 and 54, respectively.

Radial protrusion 56 is shown axially along an axial edge of cover 16. Radial protrusion 56 is used as a stop for the rotation of cover 16. There is enough play between cover 16 and cradle 14 such that when radial protrusion is pushed into cradle 14 it can act as a stop for rotation of cover 16.

Cradle 14 has first end wall 58 and second end wall 60. First blind hole 62 is in first end wall 58 and second blind hole 64 is in second wall 60.

First open ring protrusion 44 is rotatable mounted in first blind hole 62, and second open ring protrusion 46 is rotatably mounted in second blind hole 64. The inner radial surface of first and second blind hole 62, 64 is slightly larger than the outer radial surface of open ring protrusion 44 and 46 to allow open ring protrusion 44 and 46 to freely rotate inside blind hole 62, 64.

As can be seen in the figures, cradle 14 and cover 16 roller 18 are all coaxial with the axis of cleaning device 10.

Slits 48 and 50 provide flexibility to blind hole 36 and 38 such that when the user grips the end wall 58 and 60 between his thumb and index finger the user can hold the cover in the open position and still allow the roller to rotate within the opened housing as it rolls across a surface so as to clean the surface using the adhesive sleeve.

When the user is done, the user rotates the cover to close the housing and secure the roller from exterior dirt and particles.

Suitably, the roller device is about 4 inches (10 cm) in length and about 1.25 inches (3 cm) in diameter. This allows for easy grasping between a user's index finger and thumb.

Figure 6:
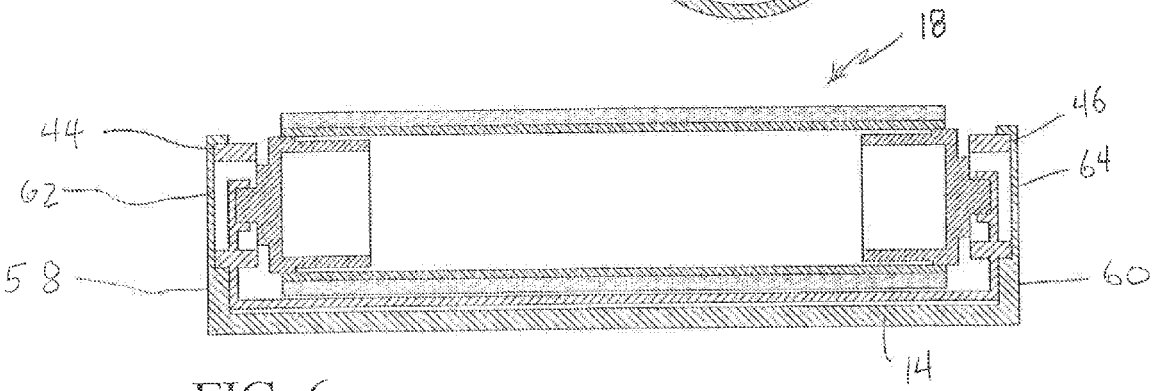
FIG. 6 is a cross sectional view along line 6-6 of FIG. 2.
Figure 7:
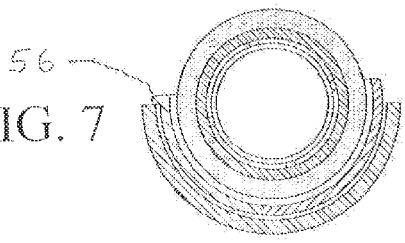
FIG. 7 is a cross sectional view along line 7-7 of FIG. 2.

In order to avoid the hard plastic cradle 14 and cover 16 from scratching the screen surface, the outer surface of adhesive sleeve 20 should project a radial distance beyond the edges of cradle 14 and cover 16 when the cleaning is in the open position. FIG. 6 illustrates the outer surface of the adhesive sleeve 20 radially extending beyond the edges of cradle and cover 16. A minimum radial distance of 2 mm is preferred.

In order to clean the roller, the roller is washed with water. There is no need for chemicals to clean the roller. Thus, the roller can be placed under tap water to clean and is then reusable. The tacky surface is then ready for further use.

While only a limited number of specific embodiments of the present Invention have been expressly disclosed it is, nonetheless, to be broadly construed and not to be limited except for the character of the claims appended hereto.

What is claimed is:

1. A device for cleaning a surface, comprising:

a cylindrical housing having a semi-cylindrical cradle and a semi-cylindrical cover rotatably mounted inside the cradle, a roller rotatably mounted inside the cover; and an adhesive sleeve mounted on the roller, between the roller and the housing, for cleaning a surface on which the sleeve rolls when the cover has been rotated to an open position;

wherein the cover has an end wall at each axial end of the cover, each end wall of the cover having a first side at least partially facing a surface of the roller, and a second side at least partially facing a surface of the cradle, and an open ring disposed on the second side and extending axially outward from the second side of the end wall toward the cradle.

2. The device of claim 1, wherein the roller has a pin extending axially outward from each axial end of the roller;

the cover further comprises a blind hole in each end wall of the cover, the blind hole in each end wall of the cover open axially inward and closed axially outward, and the pin of each axial end of the roller is rotatably mounted in the blind hole of the corresponding end wall of the cover; and the cradle has an end wall at each axial end of the cradle, a blind hole in each end wall of the cradle, the blind hole in each end wall of the cradle open axially inward and closed axially outward, each end wall of the cradle axially opposing a corresponding end wall of the cover, and the open ring of each end wall of the cover is rotatably mounted in the blind hole of the corresponding end wall of the cradle.

3. The device of claim 2, wherein each end wall of the cover is semi-circular; and each end wall of the cradle is semi-circular.

4. The device of claim 3, wherein each semi-circular end wall of the cover, the open ring of each end wall of the cover and the blind hole in each end wall of the cover are coaxial.

5. The device of claim 4, wherein semi-circular slits are formed in the end wall of the cover between the blind hole and open ring.

6. The device of claim 3, wherein each semi-circular end wall of the cradle and the blind hole in the end wall of the cradle are coaxial.

7. The device of claim 6, wherein each end wall of the cradle and each end wall of the cover are coaxial.

8. The device of claim 3, wherein in the open position, the cradle and the cover are radially adjacent.

9. The device of claim 2, wherein the pin has an axial inward sleeve that mounts axially inside the roller and two radially stepped, axial protrusions that are coaxial.

10. The device of claim 9, wherein the pin has a first radial step and a second radial step which is axially adjacent and axial outward from the first radial step; and the second radial step is rotatably mounted in the blind hole of the end wall of the cover.

11. The device of claim 1, wherein the cover has a radial protrusion extending radially outward from an axial edge of the semi-cylindrical cover.

12. The device of claim 1, wherein the adhesive sleeve comprises an elastomeric material.

13. The device of claim 1, wherein the cradle, cover and roller are coaxial.

14. A device for cleaning a surface, comprising:

a cylindrical housing having a semi-cylindrical cradle and a semi-cylindrical cover rotatably mounted inside the cradle;

a roller rotatably mounted inside the cover, the roller comprising a pin extending axially outward from each axial end of the roller, the pin comprising an axially inward sleeve that mounts axially inside the roller, the pin further comprising first and second radial steps comprising respective axial protrusions that are coaxial, wherein the first radial step has a first diameter smaller than a second diameter of the inward sleeve, and the second radial step is axially adjacent and axially outward from the first radial step and rotatably mounted in a blind hole located in an end wall of the cover; and an adhesive sleeve mounted on the roller, between the roller and the housing, for cleaning a surface on which the sleeve rolls when the cover has been rotated to an open position;

wherein the cover has an end wall at each axial end of the cover, each end wall of the cover having a first side at least partially facing a surface of the roller, and a second side at least partially facing a surface of the cradle, and an open ring disposed on the second side and extending axially outward from the second side of the end wall toward the cradle.

* * * * *